US007320581B2

(12) United States Patent
Allen et al.

(10) Patent No.: US 7,320,581 B2
(45) **Date of Patent: *Jan. 22, 2008**

(54) STABILIZED FILAMENT DRAWING DEVICE FOR A MELTSPINNING APPARATUS

(75) Inventors: Martin A. Allen, Dawsonville, GA (US); Patrick L. Crane, Dawsonville, GA (US); Steven Clark, Cumming, GA (US); Matthew Thompson, Cumming, GA (US)

(73) Assignee: Aktiengesellschaft Adolph Saurer (CH)

( * ) Notice: Subject to any disclaimer, the term of this patent is extended or adjusted under 35 U.S.C. 154(b) by 429 days.

This patent is subject to a terminal disclaimer.

(21) Appl. No.: 10/714,778

(22) Filed: Nov. 17, 2003

(65) Prior Publication Data

US 2005/0104261 A1 May 19, 2005

(51) Int. Cl.
*B28B 5/00* (2006.01)

(52) U.S. Cl. ..... 425/72.2; 264/211.14

(58) Field of Classification Search ..... 425/72.2; 264/211.14

See application file for complete search history.

(56) References Cited

U.S. PATENT DOCUMENTS

| | | | | |
|---|---|---|---|---|
| 2,052,869 A | | 9/1936 | Coanda | 299/107 |
| 3,274,644 A | * | 9/1966 | Moore et al. | 425/72.2 |
| 3,485,428 A | | 12/1969 | Jackson | 226/97 |
| 3,692,618 A | | 9/1972 | Dorschner et al. | 161/72 |
| 3,981,650 A | * | 9/1976 | Page | 425/72.2 |
| 4,014,487 A | | 3/1977 | Reba et al. | 226/5 |
| 4,159,200 A | * | 6/1979 | Shono et al. | 65/496 |
| 4,285,452 A | | 8/1981 | Reba et al. | 226/7 |
| 4,472,886 A | | 9/1984 | Reba | 34/10 |
| 5,045,271 A | | 9/1991 | Mente et al. | 264/555 |
| 5,162,074 A | | 11/1992 | Hills | 156/644 |
| 5,225,018 A | | 7/1993 | Zeldin et al. | 156/167 |
| 5,312,500 A | | 5/1994 | Kurihara et al. | 156/62.4 |
| 5,397,413 A | | 3/1995 | Trimble et al. | 156/167 |
| 5,807,795 A | | 9/1998 | Lau et al. | 442/334 |
| 5,993,943 A | | 11/1999 | Bodaghi et al. | 428/198 |
| 6,182,732 B1 | | 2/2001 | Allen | 156/441 |
| 6,244,845 B1 | * | 6/2001 | Milligan et al. | 425/7 |
| 6,247,911 B1 | * | 6/2001 | Milligan | 425/7 |
| 6,338,814 B1 | | 1/2002 | Hills | 264/510 |
| 6,499,982 B2 | | 12/2002 | Allen et al. | 425/83.1 |
| 6,511,566 B1 | | 1/2003 | Wessel et al. | 156/181 |
| 6,524,521 B1 | | 2/2003 | Kuroiwa et al. | 264/555 |

(Continued)

FOREIGN PATENT DOCUMENTS

| | | |
|---|---|---|
| WO | 02/052071 | 7/2002 |

(Continued)

*Primary Examiner*—Yogendra N. Gupta
*Assistant Examiner*—Dimple N. Bodawala
(74) *Attorney, Agent, or Firm*—Moore & Van Allen PLLC

(57) ABSTRACT

A stabilized filament drawing device for a meltspinning apparatus. The stabilized filament drawing device applies a high-velocity flow of air to attenuate the filaments, which are discharged from a device outlet in a discharge direction. The filament drawing device includes multiple inclined guides adjacent to the outlet that cause the high-velocity flow of air to deviate from the discharge direction by the Coanda effect. The filaments, which are entrained in the high-velocity process air, likewise deviate from the discharge direction. The guides are arranged such that spaces are absent between adjacent guides.

31 Claims, 3 Drawing Sheets

U.S. PATENT DOCUMENTS

| | | | | |
|---|---|---|---|---|
| 6,709,623 | B2 * | 3/2004 | Haynes et al. | 264/465 |
| 6,989,125 | B2 * | 1/2006 | Boney et al. | 264/465 |
| 2003/0147982 | A1 | 8/2003 | Allen | 425/72.2 |
| 2006/0172024 | A1 * | 8/2006 | Bentley et al. | 425/72.2 |

FOREIGN PATENT DOCUMENTS

| | | |
|---|---|---|
| WO | 2004/048664 | 6/2004 |

* cited by examiner

STABILIZED FILAMENT DRAWING DEVICE FOR A MELTSPINNING APPARATUS

FIELD OF THE INVENTION

The invention relates generally to apparatus for forming spunbond nonwoven webs and, more particularly, to apparatus and methods for stabilizing the paths of airborne filaments in spunbond meltspinning devices.

BACKGROUND OF THE INVENTION

Nonwoven webs and their manufacture from melt-processable thermoplastic polymers has been the subject of extensive development resulting in a wide variety of materials for numerous commercial applications. Nonwoven webs formed from a spunbond process consist of a sheet of overlapped and entangled filaments or fibers of melt-processable thermoplastic polymers. A spunbond process generally involves extruding a dense curtain of semi-solid filaments from a spinneret of a spin pack. The descending curtain of filaments is cooled by a cross flow of cooling air and the individual filaments are attenuated or drawn by a filament drawing device or aspirator. Spunbond filaments are generally lengthwise continuous and have average diameters in the range of about 10 to 20 microns. Filaments discharged from the drawing device are collected as a sheet of entangled loops on a collector, such as a forming belt or a forming drum, and are deposited as a continuous length nonwoven web.

Various different types of conventional drawing devices are available for use in meltspinning apparatus. Generally, a drawing device receives the curtain of filaments descending from the spinneret in a slotted passageway and directs a high-velocity stream of process air at the filaments from one or more venturis or air jets exhausting into the passageway. Each air stream is oriented substantially tangential to the filament length and exerts a drawing force on the filaments that increases the filament velocity. The drawing force attenuates the filaments in the space between the spinneret and the drawing device inlet and in the space between the drawing device and the collector. In addition, the polymer chains constituting the filaments may be oriented if the filament velocity or spinning speed is sufficiently high.

Certain characteristics of the high-velocity stream of process air used to attenuate the filaments are believed to degrade the quality of the collected nonwoven web. In one aspect, the high-velocity stream of process air exiting the venturis creates lateral vortices that travel down the confronting planar surfaces defining the slotted passageway and eventually exit the passageway outlet along with the filaments and high-velocity process air. The interaction of the lateral vortices with the descending filaments and the high-velocity of the stream of process air causes unpredictable variations in the looping of the filaments. As a result, localized areas of relatively low web density and relatively high web density occur that reduce the long range uniformity of the collected nonwoven web. This loss of uniformity may be undesirable for those end products intended to be fluid impervious, as the low-density areas define unacceptable leakage paths that defeat use as a barrier material.

The high-velocity process air aspirates secondary air from the environment adjacent the outlet, which mixes with the process air and filaments at the end and side boundaries of the outlet from the drawing device. The mixing causes the airborne filaments to oscillate in a chaotic and random manner in the flight path from the outlet of the drawing device to the collection device. The randomized movement of the airborne filaments decreases the integrity of the nonwoven web due to variations in coverage. The aspirated secondary air at the end boundaries of the outlet also produces inwardly-directed currents of secondary air that cause filaments exiting adjacent to the end boundaries to move inwardly as they travel toward the collection device, which increases the local filament density adjacent to the end boundaries. As a result, the opposite peripheral margins of the nonwoven web have an increased basis weight.

A conventional technique for decreasing the randomness and chaotic character of the paths traced by filaments during their descent to the collector is to provide the drawing device with rows of thin fingers or guide fins upstream of the outlet. Conventional guide fins are formed of bent strips of thin sheet metal arranged into two rows extending in the cross-machine direction, which are separated by an open space or tunnel. Guide fins in the upstream row are inclined and those in the downstream row are oriented vertically. Adjacent pairs of guide fins in each row are separated by a small gap. The guide fins in the downstream row are arranged to be offset by one-half of the row pitch from the guide fins in the upstream row so that the upstream row is not covered.

Nevertheless, the rows of guide fins fail to prevent the difficulties associated with the mixing of aspirated secondary air and the high-velocity process air exiting the drawing device and introduce additional artifacts into the structure of the nonwoven web. Secondary air is aspirated through the gaps between adjacent guide fins in each row and flows through the space between the two rows. The aspirated air flowing through the gaps between the guide fins toward the filaments causes filaments being guided by the upstream row to shift laterally (i.e., in the cross-machine direction) so that the resultant nonwoven web has alternating low-density and high-density stripes spaced across the width of the web with the periodicity of the guide fin pitch. The striping reduces the integrity of the nonwoven web and causes undesirable formation variations.

Raising the drawing device away from the collection device reduces the striping and increases filament entanglement and web integrity. However, as the distance is increased between the drawing device outlet and the collection device, chaotic movement of the filaments increases the loop size of the collected filaments and bundling or twisting. Web quality is reduced by the occurrence of random localized areas of relatively low web density and areas of relatively high web density.

Conventional guide fins cannot eliminate the lateral vortices from the high-velocity air exiting the drawing device, which further increases the randomness of, and lack of control over, the trajectories of the descending filaments. Because the guide fins are formed from bent sheet metal, they lack robustness and are easily bent out of position by accidental contact.

A need exists, therefore, to improve the stability and the guidance of airborne filaments descending from the drawing device to the collector.

SUMMARY

The invention provides a filament drawing device for a meltspinning apparatus including at least one manifold that includes an inlet receiving the filaments from a spin pack of a meltspinning apparatus, an outlet, and a slotted passageway extending between the inlet and the outlet. The manifold is adapted to apply a high-velocity flow of air in the slotted passageway effective to attenuate the filaments. The filaments and the air are discharged from the outlet in a discharge direction. Positioned proximate to the outlet is a first plurality of guides aligned in a first row. Each of the first plurality of guides is inclined at a first angle relative to the discharge direction. A second plurality of guides is positioned proximate to the outlet of the filament drawing device and aligned in a second row. Each of the second plurality of guides is positioned between an adjacent pair of the first plurality of guides. Each of the second plurality of guides is inclined at a second angle relative to the discharge direction. The guides cause the flow of air and the filaments to deviate from the discharge direction.

In accordance with the principles of the invention, the guides of the drawing device separate the descending sheet or curtain of airborne filaments into two distinct sheets or curtains that are spaced in the machine direction. The individual guides of the stabilizing device promote a barrier action that counteracts the vortices and, thereby, prevent the propagation of the vortices from the drawing device outlet to the collection device. This reduces the randomness of the filament trajectories by eliminating or, at the least, significantly reducing turbulence.

The individual guides channel the high-velocity process air into discrete, aerodynamic columns that remain substantially undisturbed and intact between the drawing device outlet and the collection device. The guides also dissipate filament energy, which slows the filament velocity. Because of these beneficial effects, filament looping is more controlled and compact, which increases filament entanglement and thereby enhances web integrity by providing a greater degree of filament interlocking. Because the two rows of guides are not separated by open areas, ambient air cannot be aspirated between the individual guides, which prevents or, at the least, lessens filament twisting and bundling. The elimination of open areas also permits the drawing device outlet to be placed closer to the collection device during operation without inducing web striping. The guides also eliminate, or at least reduce, the inward movement of airborne filaments proximate the side edges of the drawing device outlet.

In accordance with the invention, a method of forming a nonwoven web comprises forming filaments from a thermoplastic material and applying a high-velocity flow of air in a drawing device effective to attenuate the filaments. The filaments and the flow of air are directed in a discharge direction from an outlet of the drawing device along with vortices. The method further includes eliminating the vortices in the high-velocity flow of air and collecting the filaments on a collection device to form a nonwoven web.

The drawing devices of the invention may also be used to add directionality to the strength of the nonwoven web. Specifically, the guides may be configured to provide the nonwoven web with a substantially isotropic strength by tailoring the filament loops to provide a machine direction to cross-machine direction (MD/CD) strength ratio of about 1:1 to 2:1. Alternatively, the guides may be configured to provide a highly anisotropic web that is stronger in the machine direction than in the cross-machine direction by adjusting the MD/CD strength ratio to be in the range of greater than or equal to about 2:1 and less than or equal to about 10:1. One approach for tailoring the MD/CD strength ratio is to adjust the configuration of the guides to vary filament elongation in the machine direction. Another approach for tailoring the MD/CD strength ratio is to vary the separation between the drawing device outlet and the collection device to intentionally produce stripes of relatively low web density separating stripes of relatively high web density.

In accordance with the principles of the invention, the filaments may be drawn to a smaller diameter using significantly less air flow in the drawing device. The savings in process air consumption translates to significant customer savings, reductions in capital equipment costs as the air handling capacity of blowers serving the filament drawing device may be reduced, and reduced consumable costs.

These and other objects and advantages of the present invention shall become more apparent from the accompanying drawings and description thereof.

BRIEF DESCRIPTION OF THE FIGURES

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE PREFERRED EMBODIMENTS

The invention is directed to apparatus and method for controlling the flight of spunbond filaments in the space between the slotted outlet of a drawing device and a collection device. To that end, a drawing device includes multiple guides that interact with the high-velocity air flow and entrained filaments to influence filament laydown on the collection device. Although the invention will be described herein as being associated with an exemplary meltspinning system, it should be understood that modifications to the exemplary meltspinning system described herein could be made without departing from the intended spirit and scope of the invention.

Figure 1:
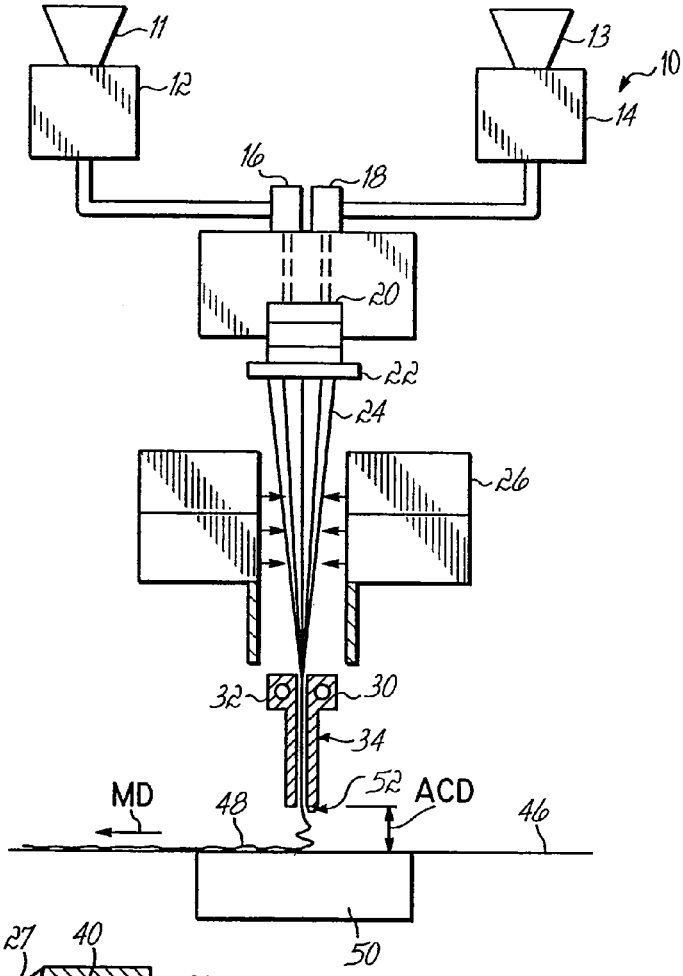
FIG. 1 is a side view of a meltspinning apparatus in partial cross-section for forming a nonwoven web in accordance with the principles of the invention.

With reference to FIG. 1, a spunbonding apparatus 10 is equipped with a pair of screw extruders 12, 14 that each convert a solid melt-processable thermoplastic polymer into a molten state and transfer the molten thermoplastic polymers under pressure to a corresponding set of metering pumps 16, 18. Pellets of thermoplastic polymers are placed in hoppers 11, 13 and fed to the corresponding one of screw extruders 12, 14. Each of the sets of metering pumps 16, 18 pump metered amounts of the corresponding thermoplastic polymers to a spin pack 20, which combines the thermoplastic polymers. Spin packs are familiar to persons of ordinary skill in the art and, therefore, are not described here in detail. Generally, spin pack 20 includes flow passageways arranged to separately direct the thermoplastic polymers to a spinneret 22. The spinneret 22 includes rows of spinning orifices (not shown) from which a dense curtain of filaments 24 each constituted collectively by the two thermoplastic polymers is discharged. As will be understood in accordance with the principles of the invention, the spunbonding apparatus 10 may combine more than two different thermoplastic polymers to form multicomponent filaments 24, may combine two identical polymers to form monocomponent filaments 24, or may include a single extruder for forming monocomponent filaments 24. An exemplary spin pack 20 is disclosed in U.S. Pat. No. 5,162,074, the disclosure of which is hereby incorporated by reference herein in its entirety.

The filaments 24 may be fabricated from thermoplastic polymer(s) selected from among any commercially available spunbond grade of a wide range of thermoplastic polymer resins, copolymers, and blends of thermoplastic polymer resins, including, without limitation, polyolefins, such as polyethylene and polypropylene, polyesters, nylons, polyamides, polyvinyl acetate, polyvinyl chloride, polyvinyl alcohol, and cellulose acetate. Additives such as surfactants, colorants, anti-static agents, lubricants, flame retardants, antibacterial agents, softeners, ultraviolet absorbers, polymer stabilizers, and the like may also be blended with the thermoplastic polymer provided to the spin pack 20. The invention contemplates that each constituent thermoplastic polymer in the filaments 24 may be identical in base composition and differ only in additive concentration. The shape of the spinning orifices in spinneret 22 can be chosen to accommodate the cross-section desired for the extruded filaments.

The descending curtain of filaments 24 is quenched with a cross flow of cooling air from a quench blower 26 to accelerate solidification. The filaments 24 are drawn into a flared inlet or throat 27 of an elongated slot 28 defined between an upstream manifold 30 and a downstream manifold 32 of a drawjet or filament drawing device 34. Process air supplied from a blower (not shown) is directed through supply passageways 36, 38 inside the upstream and downstream manifolds 30, 32, respectively. Typically, the process air is supplied at a pressure of about 5 pounds per square inch (psi) to about 100 psi, typically within the range of about 30 psi to about 60 psi, and at a temperature of about 60° F. to about 85° F.

The air supply passages 36, 38 are each coupled with the slot 28 through a corresponding one of a pair of slotted channels 40, 42. Each of the slotted channels 40, 42 tapers or narrows in a direction from the corresponding one of the air supply passages 36, 38 to the slot 28 for increasing the air velocity by the venturi effect. High-velocity sheets of process air are exhausted continuously from the slotted channels 40, 42 along the opposite sides of the slot 28 in a downwardly direction generally parallel to the length of the filaments 24. Because the filaments 24 are extensible, the converging, downwardly-directed sheets of high-velocity process air attenuate and molecularly orient the filaments 24. Exemplary air flow arrangements for filament drawing devices are disclosed in U.S. patent application Ser. No. 10/072,550 and U.S. Pat. No. 6,182,732, the disclosures of which are hereby incorporated herein by reference in their entirety.

The filaments 24 are discharged from an outlet 44 of slot 28 and are propelled toward a formaminous or porous collector 46, such as a moving screen belt. The airborne filaments 24 descend toward the collector 46 with oscillatory or spiraling trajectories that increase in amplitude in the cross-machine direction with increasing distance from the outlet 44. The oscillatory trajectories are exaggerated in FIG. 1 for clarity. The filaments 24 deposit in a substantially random manner as substantially flat loops on the collector 46 to collectively form a nonwoven web 48. The collector 46 moves in a machine direction, represented by the arrow labeled MD, parallel to the continuous length of the nonwoven web 48. The width of the nonwoven web 48 deposited on collector 46 in a cross-machine direction, which is perpendicular to the machine direction and into and out of the plane of the page of FIG. 1, is substantially equal to the width of the curtain of filaments 24.

An air management system 50 positioned below the collector 46 and underneath the outlet 44 supplies a vacuum that is transferred through the collector 46 for attracting the filaments 24 onto a surface of the collector 46. The air management system 50 efficiently and effectively disposes of the high-velocity process air from the filament drawing device 34 so that filament laydown is relatively undisturbed. Exemplary air management systems 50 are disclosed in U.S. Pat. No. 6,499,982, the disclosure of which is hereby incorporated by reference herein in its entirety.

Additional spunbonding apparatus, not shown but similar to spunbonding apparatus 10, and meltblowing apparatus (not shown) may be provided downstream of spunbonding apparatus 10 for depositing one or more spunbond and/or meltblown nonwoven webs of either monocomponent or multicomponent filaments 24 on nonwoven web 48. An example of such a multilayer laminate in which some of the individual layers are spunbond and some meltblown is a spunbond/meltblown/spunbond (SMS) laminate made by sequentially depositing onto a moving forming belt first a spunbond nonwoven web, then a meltblown nonwoven web and last another spunbond nonwoven web.

References herein to terms such as "vertical", "horizontal", etc. are made by way of example, and not by way of limitation, to establish a frame of reference. In the frame of reference, downstream and upstream directions, locations and positions are specified with regard to the machine direction in which the web is moving downstream. It is understood various other frames of reference may be employed without departing from the spirit and scope of the invention.

Figure 2:
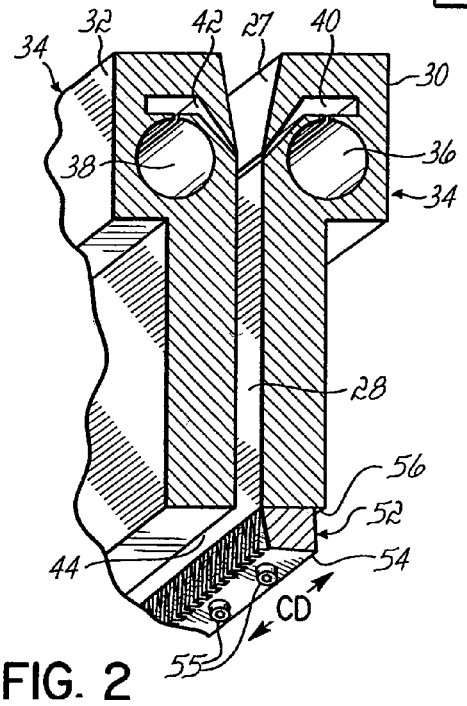
FIG. 2 is a perspective view of a portion of FIG. 1.
Figure 3:
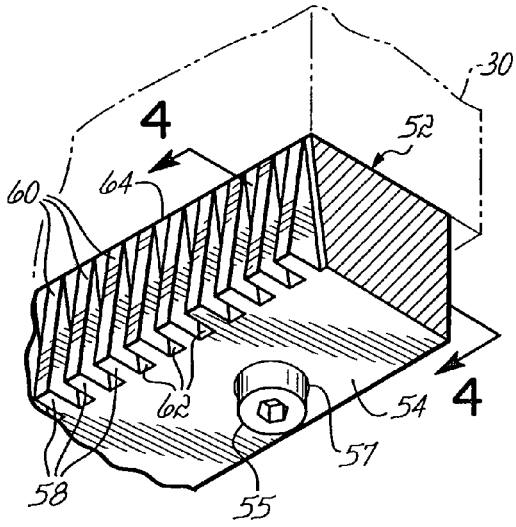
FIG. 3 is a bottom perspective view of a portion of the drawing device of FIG. 1.

With continued reference to FIGS. 1-3 and in accordance with the principles of the invention, the upstream manifold 30 of the filament drawing device 34 features a stabilizer 52. The stabilizer is effective to cause the sheet of air and filaments 24 discharged from the slot 28 to experience an unbalanced and directional flow. The stabilizer 52 includes an elongated body 54 that extends across the width of the upstream manifold 30 in a cross-machine direction, represented by the arrow labeled CD. Body 54 projects downwardly from a lower surface 56 of the upstream manifold 30 and generally toward the collector 46 so that the upstream manifold 30 has a greater effective vertical dimension than the downstream manifold 32. Body 54 includes bolt holes 57 that receive conventional fasteners 55 (FIG. 2) for mounting the stabilizer 52 to the filament drawing device 34. The lower surface 56 of the upstream manifold is spaced from the collector 46 by a separation labeled as ACD in FIG. 1.

Figure 4:
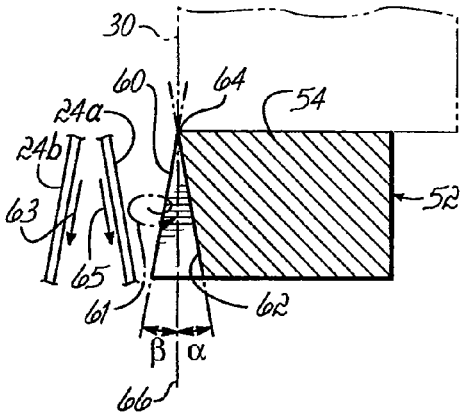
FIG. 4 is a cross-sectional view taken generally along line 4-4 of FIG. 3.

With reference to FIGS. 2-4, the body 54 includes a plurality of substantially-parallel bosses 58 of triangular transverse cross-section viewed parallel to the cross-machine direction. Each of the bosses 58 defines one of a corresponding plurality of first guides 60, which are arranged in a row extending in the cross-machine direction. Defined in the uniform-width recesses between adjacent pairs of bosses 58 is a plurality of second guides 62, likewise arranged in a row extending in the cross-machine direction. The first and second guides 60, 62 diverge from an edge 64 extending parallel to the cross-machine direction toward the collector 46 and are located upstream of outlet 44 from a downstream perspective. Guides 60 alternate or are interleaved with guides 62 in the cross-machine direction. Bosses 58 introduce discontinuities that disrupt or interrupt the cross flow of aspirated air in the cross-machine direction along the guides 60, 62. In addition, any vortices 61 (FIG. 4) representing circular airflow will be disrupted by the presence of the bosses 58, which eliminates flow of aspirated air in the cross-machine direction. No open spaces are present between the rows of guides 60, 62.

Each of the first and second guides 60, 62 is angled relative to a plane 66 positioned with a bisecting relationship between the row of first guides 60 and the row of second guides 62. Plane 66 may extend parallel to a vertical plane extending through the midline of the slot 28. Each of the guides 62 is angled relative to plane 66 with a negative declination angle $\alpha$ in an upstream direction and each of the guides 60 is angled relative to plane 66 with a positive declination angle $\beta$ in a downstream direction. Typically, the declination angles of the guides 60, 62 are equal and opposite about plane 66 so that the set of guides 60 has planar symmetry with the set of guides 62, although the invention is not so limited. Adjacent pairs of guides 60 and adjacent pairs of guides 62 each have a uniform center-to-center spacing and width in the cross-machine direction, although the invention is not so limited. Each set of guides 60, 62 may have a repeating pattern, as depicted in FIGS. 2-4 or a non-repeating pattern. As an example of a non-repeating pattern, one or both sets of guides 60, 62 may have a declination angle that varies with location in the cross-machine direction, such as an increasing declination extending in both transverse directions relative to the center of body 54 so that guides 60, 62 near the center of body 54 have a smaller declination angle than guides 60, 62 at the transverse edges of body 54.

The guides 62 have a non-overlapping relationship with guides 60 so that, when viewed from the perspective of a downstream location, each of the surfaces 60, 62 is fully visible to the filaments 24. As a result, each of guides 60 has a non-overlapping relationship with the adjacent pair of upstream guides 62 and, similarly, each of guides 62 has a non-overlapping relationship with the adjacent pair of downstream guides 60. The high-velocity sheet of air discharged from outlet 44 of slot 28 has an inherent tendency to aspirate or entrain secondary air from the surrounding environment. The stabilizer 52 blocks aspiration of secondary air in an upstream to downstream direction from the air space beneath the upstream manifold 30, as no spaces are present between adjacent guides 60, 62.

With reference to FIG. 4, the guides 60, 62 partition the sheet of air into a plurality of columnar air streams represented diagrammatically by arrows 63 and 65. Each individual columnar air stream 63, 65 is guided or steered by one of the guides 60, 62. Specifically, guides 60 deflect the columnar air streams 63 in an upstream direction due to the declination of each individual guide 62 in an upstream direction. Filaments 24*b* represent a portion of filaments 24 guided downstream or in the machine direction by guides 60. Filaments 24*a*, which are entrained in columnar air streams 65 deflected by guides 62, represent a portion of filaments 24 that are deflected in the upstream direction or counter to the machine direction. The travel path of the filaments 24 follows the deflected columnar air streams 63, 65. The deflection of the filaments 24 and entraining air is believed to arise from a phenomenon known as the Coanda effect. The term "deflect" is used consistently with its common dictionary definition of to turn aside especially from a straight course or fixed direction. In this instance, the filaments 24*a,b* are deflected relative to their discharge direction when exiting the outlet 44 of the filament drawing device 34.

The effect of the guides 60, 62 is to split the descending curtain of filaments 24 into two separate descending curtains, namely, a first descending curtain of filaments 24*a* deflected in an upstream direction and a second descending curtain of filaments 24*b* deflected in a downstream direction. The deflection is accomplished without contact occurring between the filaments 24 and guides 60, 62. The presence of two distinct curtains of filaments 24*a* and 24*b* increases web uniformity and integrity of the collected nonwoven web 48 (FIG. 1). The disruption of the circulation of vortices 61, as mentioned above, also contributes to increasing web uniformity and integrity by reducing or eliminating localized areas of relatively low web density and relatively high web density.

With reference to FIGS. 2-4, the characteristics of the guides 60, 62 influence the characteristics of filament deflection and subsequent laydown on the collector 46. The characteristics of the guides 60, 62 that define the columnar air streams 63, 65 reduce the randomness in the movement of the filaments during descent and, thereby, control the filament looping so that the loops are more compact for a given ACD (FIG. 1) than observed for conventional guiding schemes. For typical airflow rates from the filament drawing device 34, the vertical dimension or length of each of the guides 60, 62 is on the order of 0.5 inch to about 3.0 inches. The center-to-center spacing between adjacent guides 60 and adjacent guides 62 may vary between about 0.2" to about 0.75". Each of the guides 60, 62 is tilted or angled relative to the vertical plane 66 between about 3° and about 30°, preferably about 10°. The guides 60 and guides 62 may have equal declination angles or the declination angles may vary either in a periodic manner or irregularly in the cross-machine direction. For example, the declination angle of each independent set of guides 60, 62 or both sets of guides 60, 62 may have a non-repeating pattern that decreases with increasing distance from the cross-machine midpoint of the body 54.

Figure 5A:
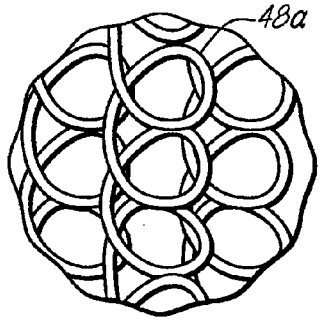
FIGS. 5A and 5B are diagrammatic views of a portion of a nonwoven web in accordance with the principles of the invention.
Figure 5B:
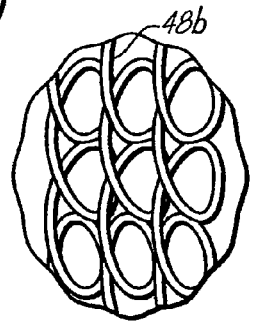
Figure 4A:
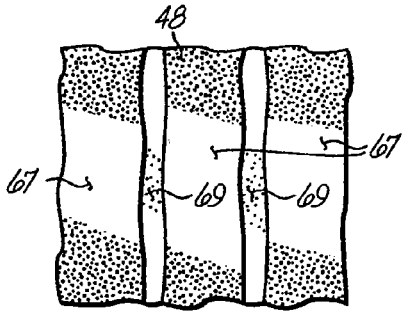
FIG. 4A is a diagrammatic top view of a portion of nonwoven web produced in accordance with the principles of the invention.

With reference to FIGS. 5A and 5B, the characteristics of the guides 60, 62 may be selected to modify to vary the shape of the filament loops on the collector 46. With reference to FIG. 5A, the guides 60, 62 may be configured so that the filament loops 48*a* are nearly circular and non-directional, which produces an isotropic MD/CD strength ratio in the range of about 1:1 to 2:1. With reference to FIG. 5B, the guides 60, 62 may be configured such that filament loops 48*b* of nonwoven web 48 deposit on collector 46 with significant elongation in the machine direction. This supplies an anisotropic MD/CD strength ratio of about 2:1 to 10:1, depending upon the extent of the elongation.

Alternatively and with reference to FIGS. 1-4 and 4A, the spunbonding apparatus 10 may also be configured for tailoring the strength of the nonwoven web 48. Specifically, the ACD may be adjusted to intentionally introduce stripes 67 of relatively high web density separated by stripes 69 of relatively low web density. The presence of the stripes 67, 69 results in an anisotropic machine to cross-machine direction (MD/CD) strength ratio, considered to be anisotropic for MD/CD strength ratios in the range of about 2:1 to 10:1. Generally, the striping occurs for an ACD that is less than twice the vertical dimension or length of the guides 60, 62 and increases with decreasing ACD. Compared with conventional guiding schemes, the action of the guides 60, 62 prevents the occurrence of random localized areas of relatively low web density and areas of relatively high web density in the nonwoven web. If striping is not desired, the ACD distance is selected such that filaments 24 guided by adjacent guides 60, 62 are more overlapping in the cross-machine direction, which produces isotropic MD/CD strength ratios of 1:1 to about 2:1. Generally, the ACD should be increased as the cross-machine dimension or transverse width of the guides 60, 62 is increased to prevent the occurrence of stripes of material having filament loops 48*b*.

Figure 6:
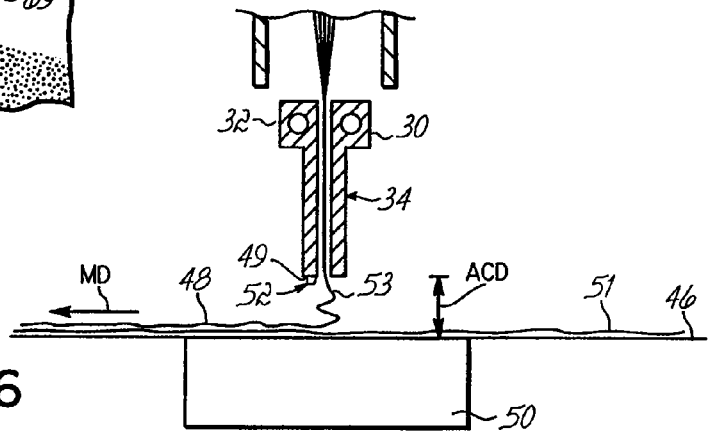
FIG. 6 is a side view in partial cross-section of a meltspinning apparatus in accordance with an alternative embodiment of the invention.

With reference to FIG. 6 in which like reference numerals refer to like features in FIGS. 1-4 and in accordance with an alternative embodiment of the invention, the body 54 may be mounted to a lower surface 49 of the downstream manifold 32. To that end, body 54 is oriented such that the guides 60, 62 face toward outlet 44 of the filament drawing device 34.

Figure 7:
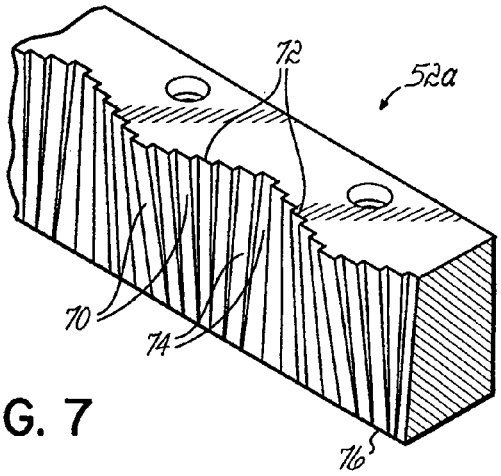
FIG. 7 is a partial bottom perspective view of an alternative embodiment of a drawing device in accordance with the principles of the invention, which is shown inverted for clarity.
Figure 8:
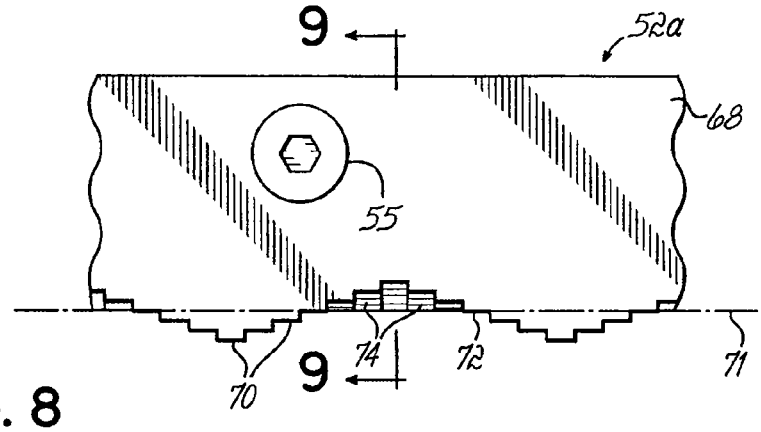
FIG. 8 is a bottom view of the drawing device of FIG. 7.
Figure 9:
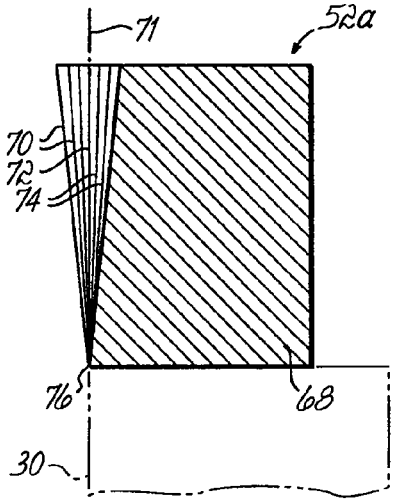
FIG. 9 is a cross-sectional view taken generally along line 9-9 in FIG. 8.

With reference to FIGS. 7-9 and in accordance with an alternative embodiment of the invention, a stabilizer 52*a* of drawing device 34 (FIG. 2) includes an elongated body 68 and a plurality of guides, generally indicated by reference numerals 70, 72 and 74, arranged with a systematic patterned relationship that repeats across the width of the body 68 in the cross-machine direction. Specifically, the guides 70 and 74 are systematically angled at equal angular increments between a positive maximum angle and a negative maximum angle symmetrical about a vertical plane 71 containing guides 72 and diverge from an edge 76. The declination angle of the individual guides 70 varies progressively from the maximum positive angle to vertical and, similarly, the declination angle of the individual guides 74 varies progressively from the maximum negative angle to vertical. Guides 70 are angles in a downstream direction, guides 72 are vertical, and guides 74 are angled in an upstream direction. In an exemplary embodiment, the declination angle of the guides 70 varies from +3° to a maximum of +9° to +3° in +3 increments and the declination of guides 74 varies from −3° to a maximum of −9° to −3° in −3° increments. This arrangement of guides 70, 72, 74 may cause nonwoven web 48 to have stripes of alternating MD:CD ratio in the cross-machine direction.

Figure 10:
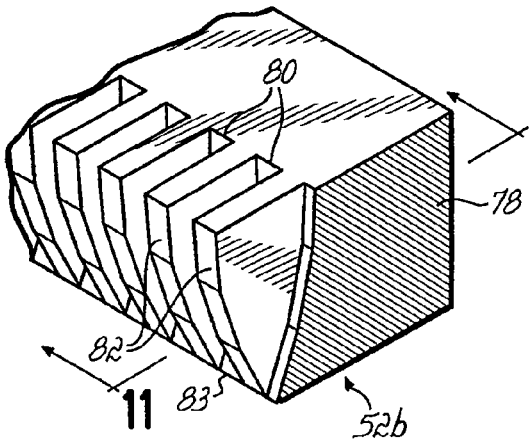
FIG. 10 is a partial perspective view of an alternative embodiment of a drawing device in accordance with the principles of the invention, which is shown inverted for clarity.
Figure 11:
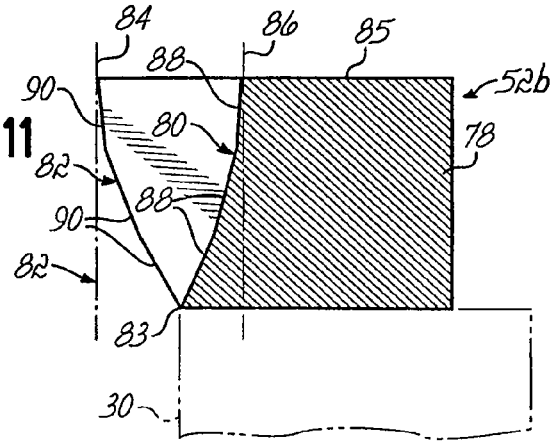
FIG. 11 is a cross-sectional view taken generally along line 11-11 of FIG. 10.

With reference to Figs 10 and 11 and in accordance with an alternative embodiment of the invention, a stabilizer 52*b* includes an elongated body 78, a plurality of first guides 80, and a plurality of second guides 82 separating adjacent guides 80. Guides 80 alternate with guides 82 in the cross-machine direction with a repeating patterned relationship across the width of the elongated body 78 and diverge from an edge 83. Each of the first guides 80 includes multiple facets 88 having corresponding declination angles, relative to a vertical plane 84, that increase in uniform increments between a top surface 85 of the stabilizer 52*b* and the edge 83. Each of the first guides 82 includes multiple facets 90 having corresponding individual declination angles, relative to a vertical plane 86, that likewise increase in uniform increments between the top surface 85 and the edge 83. Typically, the declination angle of the angled facets 88,90 on respective guides 80, 82 varies monotonically in equal angular increments. In alternative embodiments of the invention, the declination angle of the individual facets 88,90 on respective guides 80,82 may vary in a different manner.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants' general inventive concept. The scope of the invention itself should only be defined by the appended claims, Wherein we claim:

1. A drawing device for attenuating a plurality of filaments received from a spin pack of a meltspinning apparatus, said drawing device comprising:

a manifold including an inlet receiving the plurality of filaments from the spin pack, an outlet oriented in a cross-machine direction, and a passageway extending between said inlet and said outlet, said manifold having a slotted channel communicating with said passageway for discharging air in said passageway to impinge the filaments in said passageway, and said manifold discharging the filaments and the flow of air from said outlet in a downward direction perpendicular to said cross-machine direction;

a first plurality of guides positioned proximate to said outlet and aligned in a first row oriented in the cross-machine direction, each of said first plurality of guides inclined at a first angle relative to said downward direction, wherein each of said first plurality of guides has first and second side edges, a first surface extending between the first and second side edges parallel with the cross-machine direction, and second and third surfaces extending from the first and second side edges perpendicular to the cross-machine direction; and a second plurality of guides positioned proximate to the outlet of the filament drawing device and aligned in a second row oriented in the cross-machine direction, each of said second plurality of guides positioned between an adjacent pair of said first plurality of guides, and each of said second plurality of guides inclined at a second angle relative to said downward direction, wherein each of said second plurality of guides has third and fourth side edges and a fourth surface extending between the third and fourth side edges parallel with the cross-machine direction, and the second and third surfaces of each of said first plurality of guides extend to the third and fourth edges of each of said second plurality of guides, wherein said first plurality of guides and said second plurality of guides are configured to cause the flow of air and the filaments to deviate from said downward direction.

2. The drawing device of claim 1 further comprising:

a plurality of connecting surfaces each extending between one of said first plurality of guides and one of said second plurality of guides to eliminate open spaces therebetween.

3. The drawing device of claim 1 wherein said first angle is equal to said second angle.

4. The drawing device of claim 1 wherein said first angle is in the range of 3° to 3°.

5. The drawing device of claim 4 wherein said second angle is in the range of 3° to 3°.

6. The drawing device of claim 1 wherein said first plurality of guides and said second plurality of guides are inclined symmetrically about a plane containing said downward direction so that said first angle is equal and opposite to said second angle.

7. The drawing device of claim 1 wherein said first plurality of guides and said second plurality of guides are configured to cause the flow of air and the filaments to deviate in opposite upstream and downstream directions relative to said downward direction.

8. The drawing device of claim 1, wherein each guide of the first plurality of guides and of the second plurality of guides includes a surface that is parallel to the cross-machine direction.

9. The drawing device of claim 1, wherein said first angle differs from said second angle.

10. A drawing device for attenuating a plurality of filaments received from a spin pack of a meltspinning apparatus, said drawing device comprising:

a manifold including an inlet receiving the plurality of filaments from the spin pack, an outlet oriented in a cross-machine direction, and a passageway extending between said inlet and said outlet, said manifold having a slotted channel communicating with said passageway for discharging air in said passageway to impinge the filaments in said passageway, and said manifold discharging the filaments and the flow of air from said outlet in a downward direction perpendicular to said cross-machine direction; and a plurality of guides positioned proximate to said outlet and aligned in a row oriented generally in the cross-machine direction, said plurality of guides each inclined for causing the flow of air and the filaments to deviate from said downward direction, each of said plurality of guides having a plurality of facets inclined at different angles relative to said downward direction.

11. The drawing device of claim 10 wherein said different angles of said facets increase in inclination angle with increasing distance from said outlet.

12. A drawing device for attenuating a plurality of filaments received from a spin pack of a meltspinning apparatus, comprising:

at least one manifold including an inlet receiving the filaments from the spin pack, an outlet, and a slotted passageway extending between said inlet and said outlet, said at least one manifold adapted to apply a high-velocity flow of air in the slotted passageway to impinge the filaments, the filaments and the flow of air being discharged from said outlet in a discharge direction; and a plurality of guides aligned in a row proximate to said outlet, said plurality of guides each inclined for causing the flow of air and the filaments to deviate from said discharge direction, said plurality of guides having an angle relative to said discharge direction that progressively varies across a width of said outlet.

13. The drawing device of claim 12 wherein said guides are inclined at equal angular increments between first and second angles about a plane containing the discharge direction.

14. A spunbonding apparatus for depositing filaments on a collector to form a nonwoven web, comprising:

a spin pack capable of forming filaments from a thermoplastic material;

a drawing device having an inlet receiving the plurality of filaments from the spin pack, an outlet oriented in a cross-machine direction, and a passageway extending between said inlet and said outlet, said manifold having a slotted channel communicating with said passageway for discharging air in said passageway to impinge the filaments in said passageway, and said manifold discharging the filaments and the flow of air from said outlet in a downward direction perpendicular to said cross-machine direction;

a first plurality of guides positioned proximate to said outlet and aligned in a first row oriented in the cross-machine direction, each of said first plurality of guides inclined at a first angle relative to said downward direction, wherein each of said first plurality of guides has first and second side edges, a first surface extending between the first and second side edges parallel with the cross-machine direction, and second and third surfaces extending from the first and second side edges perpendicular to the cross-machine direction; and a second plurality of guides positioned proximate to the outlet of the filament drawing device and aligned in a second row oriented in the cross-machine direction, each of said second plurality of guides positioned between an adjacent pair of said first plurality of guides, and each of said second plurality of guides inclined at a second angle relative to said downward direction, wherein each of said second plurality of guides has third and fourth side edges and a fourth surface extending between the third and fourth side edges parallel with the cross-machine direction, and the second and third surfaces of each of said first plurality of guides extend to the third and fourth edges of each of said second plurality of guides, wherein said first plurality of guides and said second plurality of guides cause the flow of air and the filaments to deviate from said downward direction, and said first angle of said first plurality of guides differs from said second angle of said second plurality of guides.

15. The spunbonding apparatus of claim 14 further comprising:

a plurality of connecting surfaces each extending between one of said first plurality of guides and one of said second plurality of guides to eliminate open spaces therebetween.

16. The spunbonding apparatus of claim 14 wherein said first angle is equal to said second angle.

17. The spunbonding apparatus of claim 14 wherein said first angle is in the range of 3° to 30°.

18. The spunbonding apparatus of claim 17 wherein said second angle is in the range of 3° to 30°.

19. The spunbonding apparatus of claim 14 wherein said first plurality of guides and said second plurality of guides are inclined symmetrically about a plane containing said downward direction so that said first angle is equal and opposite to said second angle.

20. The spunbonding apparatus of claim 14 wherein said first plurality of guides and said second plurality of guides are faceted.

21. The spunbonding apparatus of claim 14 wherein said first plurality of guides and said second plurality of guides are configured to cause the flow of air and the filaments to deviate in opposite upstream and downstream directions relative to said downward direction.

22. A spunbonding apparatus for depositing a plurality of filaments on a collector to form a nonwoven web, comprising:

a spin pack capable of forming filaments from a thermoplastic material;

a drawing device having an inlet receiving the plurality of filaments from said spin pack, an outlet oriented in a cross-machine direction, and a passageway extending between said inlet and said outlet, said filament drawing device having a slotted channel communicating with said passageway for discharging air in said passageway to impinge the filaments in said passageway, and said manifold discharging the filaments and air from said outlet in a downward direction perpendicular to said cross-machine direction; and a plurality of guides positioned proximate to said outlet and aligned in a row oriented generally in the cross-machine direction, said plurality of guides each inclined for causing the flow of air and the filaments to deviate from said downward direction, each of said plurality of guides having a plurality of facets inclined at different angles relative to said downward direction.

23. The spunbonding apparatus of claim 22 wherein wherein said different angles of said facets increase in inclination angle with increasing distance from said outlet.

24. A spunbonding apparatus for depositing filaments on a collector to form a nonwoven web, comprising:

a spin pack capable of forming filaments from a thermoplastic material;

a drawing device including an inlet aligned for receiving the filaments from said spin pack, an outlet, and a slotted passageway extending from the inlet to the outlet, said filament drawing device adapted to apply a high-velocity flow of air in the slotted passageway between said inlet and said outlet to impinge the filaments, the filaments and air being discharged from said outlet in a discharge direction; and a plurality of guides aligned in a row proximate to said outlet, said plurality of guides each inclined for causing the flow of air and the filaments to deviate from said discharge direction, and said plurality of guides having an angle relative to said discharge direction that progressively varies across a width of said outlet.

25. The spunbonding apparatus of claim 24 wherein said guides are inclined at equal angular increments between first and second angles about a plane containing the discharge direction.

26. A drawing device for attenuating a plurality of filaments received from a spin pack of a meltspinning apparatus, said drawing device comprising:

a manifold including an inlet receiving the plurality of filaments from the spin pack, an outlet oriented in a cross-machine direction, and a passageway extending between said inlet and said outlet, said manifold having a slotted channel communicating with said passageway for discharging air in said passageway to impinge the filaments in said passageway, and said manifold discharging the filaments and the flow of air from said outlet in a downward direction perpendicular to said cross-machine direction; and a plurality of guides positioned proximate to said outlet and aligned in a row oriented generally in the cross-machine direction, said plurality of guides each inclined for causing the flow of air and the filaments to deviate from said downward direction, each of said plurality of guides including a surface having an increasing angle of inclination relative to said downward direction with increasing distance from said outlet.

27. A drawing device for attenuating a plurality of filaments received from a spin pack of a meltspinning apparatus, said drawing device comprising:

a manifold including an inlet receiving the plurality of filaments from the spin pack, an outlet oriented in a cross-machine direction, and a passageway extending between said inlet and said outlet, said manifold having a slotted channel communicating with said passageway for discharging air in said passageway to impinge the filaments in said passageway, and said manifold discharging the filaments and the flow of air from said outlet in a downward direction perpendicular to said cross-machine direction;

a first plurality of guides positioned proximate to said outlet and aligned in a first row oriented in the cross-machine direction, each of said first plurality of guides inclined at a first angle relative to said downward direction; and a second plurality of guides positioned proximate to the outlet of the filament drawing device and aligned in a second row oriented in the cross-machine direction, each of said second plurality of guides positioned between an adjacent pair of said first plurality of guides, and each of said second plurality of guides inclined at a second angle relative to said downward direction, wherein said first plurality of guides and said second plurality of guides are inclined relative to a plane containing said downward direction so that said first angle is a positive declination angle relative to said plane along the downward direction and said second angle is negative declination angle relative to said plane along the downward direction, such that said first angle is opposite said second angle relative to the plane, wherein said first plurality of guides and said second plurality of guides are configured to cause the flow of air and the filaments to deviate from said downward direction.

28. The drawing device of claim 27 further comprising a plurality of connecting surfaces each extending between one of said first plurality of guides and one of said second plurality of guides to eliminate open spaces therebetween.

29. The drawing device of claim 27 wherein said first angle is equal to said second angle.

30. A spunbonding apparatus for depositing filaments on a collector to form a nonwoven web, comprising:

a spin pack capable of forming filaments from a thermoplastic material;

a drawing device having an inlet receiving the plurality of filaments from the spin pack, an outlet oriented in a cross-machine direction, and a passageway extending between said inlet and said outlet, said manifold having a slotted channel communicating with said passageway for discharging air in said passageway to impinge the filaments in said passageway, and said manifold discharging the filaments and the flow of air from said outlet in a downward direction perpendicular to said cross-machine direction;

a first plurality of guides positioned proximate to said outlet and aligned in a first row oriented in the cross-machine direction, each of said first plurality of guides inclined at a first angle relative to said downward direction; and a second plurality of guides positioned proximate to the outlet of the filament drawing device and aligned in a second row oriented in the cross-machine direction, each of said second plurality of guides positioned between an adjacent pair of said first plurality of guides, and each of said second plurality of guides inclined at a second angle relative to said downward direction, wherein said first angle of said first plurality of guides differs from said second angle of said second plurality of guides, wherein said first plurality of guides and said second plurality of guides are inclined relative to a plane containing said downward direction so that said first angle is a positive declination angle relative to said plane along the downward direction and said second angle is negative declination angle relative to said plane along the downward direction, such that said first angle is opposite said second angle relative to the plane, and wherein said first plurality of guides and said second plurality of guides cause the flow of air and the filaments to deviate from said downward direction.

31. The spunbonding apparatus of claim 30 further comprising a plurality of connecting surfaces each extending between one of said first plurality of guides and one of said second plurality of guides to eliminate open spaces therebetween.

* * * * *

UNITED STATES PATENT AND TRADEMARK OFFICE

CERTIFICATE OF CORRECTION

PATENT NO. : 7,320,581 B2
APPLICATION NO. : 10/714778
DATED : January 22, 2008
INVENTOR(S) : Martin A. Allen et al.

It is certified that error appears in the above-identified patent and that said Letters Patent is hereby corrected as shown below:

Col. 11, Claim 4
Line 13, change the second "3°" to --30°--.

Col. 11, Claim 5
Line 15, change the second "3°" to --30°--.

Claim 23
Line 34, delete the second "wherein".

Signed and Sealed this

Eighth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,320,581 B2
APPLICATION NO. : 10/714778
DATED : January 22, 2008
INVENTOR(S) : Martin A. Allen et al.

It is certified that error appears in the above-identified patent and that said Letters Patent is hereby corrected as shown below:

Col. 11, Claim 4
Line 13, change the second "3°" to --30°--.

Col. 11, Claim 5
Line 15, change the second "3°" to --30°--.

Col. 13, Claim 23
Line 34, delete the second "wherein".

This certificate supersedes the Certificate of Correction issued July 8, 2008.

Signed and Sealed this

Twenty-ninth Day of July, 2008

JON W. DUDAS
*Director of the United States Patent and Trademark Office*